US007059069B2

(12) United States Patent
Raluy et al.

(10) Patent No.: US 7,059,069 B2
(45) Date of Patent: Jun. 13, 2006

(54) SHOE COMPRISING AUTOMATIC CLOSING SYSTEM

(76) Inventors: Francis Raluy, Ctra. Aldea-Tortosa, Km. 1 s/n, 43896 Aldea, Tarragona (ES); Antonio Martinez, Ctra. Aldea-Tortosa, Km. 1 s/n, 43896 Aldea, Tarragona (ES)

( * ) Notice: Subject to any disclaimer, the term of this patent is extended or adjusted under 35 U.S.C. 154(b) by 66 days.

(21) Appl. No.: 10/500,551

(22) PCT Filed: Sep. 10, 2003

(86) PCT No.: PCT/ES03/00456

§ 371 (c)(1),
(2), (4) Date: Jun. 30, 2004

(87) PCT Pub. No.: WO2004/037032

PCT Pub. Date: May 6, 2004

(65) Prior Publication Data

US 2005/0039348 A1 Feb. 24, 2005

(30) Foreign Application Priority Data

Oct. 28, 2002 (ES) ..... 200202590 U

(51) Int. Cl.
*A43B 21/00* (2006.01)

(52) U.S. Cl. ..... 36/105; 36/138

(58) Field of Classification Search ..... 36/105, 36/138, 11.5, 50.1, 50.5
See application file for complete search history.

(56) References Cited

U.S. PATENT DOCUMENTS

| | | | | |
|---|---|---|---|---|
| 2,815,588 | A | 12/1957 | Ruane | |
| 3,146,535 | A * | 9/1964 | Owings | 36/7.3 |
| 5,282,327 | A | 2/1994 | Ogle | |
| 5,481,814 | A | 1/1996 | Spencer | |
| 6,209,559 | B1 * | 4/2001 | Risch et al. | 137/1 |
| 6,594,921 | B1 * | 7/2003 | Laio et al. | 36/138 |
| 6,643,954 | B1 * | 11/2003 | Voswinkel | 36/50.1 |
| 6,938,361 | B1 * | 9/2005 | Su | 36/105 |

FOREIGN PATENT DOCUMENTS

| | | |
|---|---|---|
| DE | 201 18 134 U1 | 3/2002 |
| WO | WO 97/37556 A1 | 10/1997 |

* cited by examiner

*Primary Examiner*—Ted Kavanaugh
(74) *Attorney, Agent, or Firm*—Birch, Stewart, Kolasch & Birch, LLP

(57) ABSTRACT

Shoe having a rear attachment element (5) joined to a mobile support (6) that moves from an open position in which it is separated from the heel of the foot and a closed position in which it holds the heel piece, also connected to a mechanism housed in said heel piece (3), which mechanism can be actuated by applying pressure with the heel of the user's foot on the heel piece (3) to displace the mobile support (6) from the open to the closed position, where it is kept by first retaining-releasing means (10, 26, 50, 70, 90, 100, 110, 120, 130, 140, 150, 160), while the other foot of the user acts on a member (24, 36, 51, 71, 91, 101, 111, 121, 131, 141, 151, 152) of the mechanism for moving said mobile support (6) from the closed to the open position, where it is maintained by second elastic retaining-releasing means (7, 25, 52, 72, 92, 102, 112, 122, 132, 142, 152, 162).

32 Claims, 16 Drawing Sheets

SHOE COMPRISING AUTOMATIC CLOSING SYSTEM

This Appl. is a 371 of PCT/ES03/00456 filed Sep. 10, 2003.

OBJECT OF THE INVENTION

The present invention relates to a shoe with an automatic closure and more specifically to a shoe with an automatic closure mechanism that can be operated by the pressure of the heel of the user's foot displacing a rear retaining element of the shoe on the heel of the foot.

BACKGROUND OF THE INVENTION

For certain persons, reaching down to put on their shoes can be an uncomfortable, difficult, laborious or even impossible task, for various reasons such as old age, pregnancy, back pain, obesity, etc. For these persons, a shoe provided with an automatic closure allowing them to put it on and take it off without having to use their hands, this is, without having to reach down, would be useful.

No shoe is known in the state of the art with these characteristics.

In the field of skiing, binding devices are known for securing the special boots. worn by the user to the skis. One of these devices includes a socket attached to the front area of the ski and a closure mechanism attached to the rear part of the ski. The. boot has toe and heel protrusions specifically designed to be held by the binding device. In order to put on the skis the user, while wearing the boots, inserts the toe protrusion of the boot in the aforementioned front recess and then uses his/her heel to step on a button of the aforementioned rear mechanism that triggers a closure which engages the rear protrusion of the boot. To release the boot, the other foot must be used to step on a lever of the rear mechanism that is placed in its position when the mechanism is closed. However, this device is not applicable to close a shoe over a foot that is naked or covered only by a sock.

DESCRIPTION OF THE INVENTION

The present invention provides a shoe with an automatic closure, this shoe being one of the usual kind, comprising a sole with a toe piece to which is joined at least one front attachment element to attach a front part of the foot, and a heel piece to which is connected at least one rear attachment element to attach a rear part of the foot. The shoe is characterised in that said rear attachment element is joined to or is part of a mobile support that, when acted upon by elastic means, can move from a closed to an open position.

According to another example of embodiment, the mechanism comprises elastic means that push the aforementioned mobile support towards the closed position and retaining-releasing means that retain the mobile support in the open position against the action of said elastic means. These retaining means are configured and arranged in relation to the upper and lower elements such that when the upper element is pressed on by the heel of the user's foot to bring it near the lower element, the retaining means are returned to a releasing position thereby releasing the aforementioned mobile support, which moves back to the closed position by the action of the elastic means. The mobile support can be displaced by the user, acting with the other foot on a member of the rear attachment element or the mobile support, from the closed position to the open position against the action of the elastic means, during which displacement the upper and lower elements are separated or allowed to separate until the retaining means are automatically placed in a position for retaining the mobile support in the open position.

DESCRIPTION OF THE DRAWINGS

These and other characteristics and advantages of the invention will be better understood in view of the following detailed description of examples of embodiments made with reference to the accompanying drawings, in which.

PREFERRED EMBODIMENT OF THE INVENTION

Figure 1:
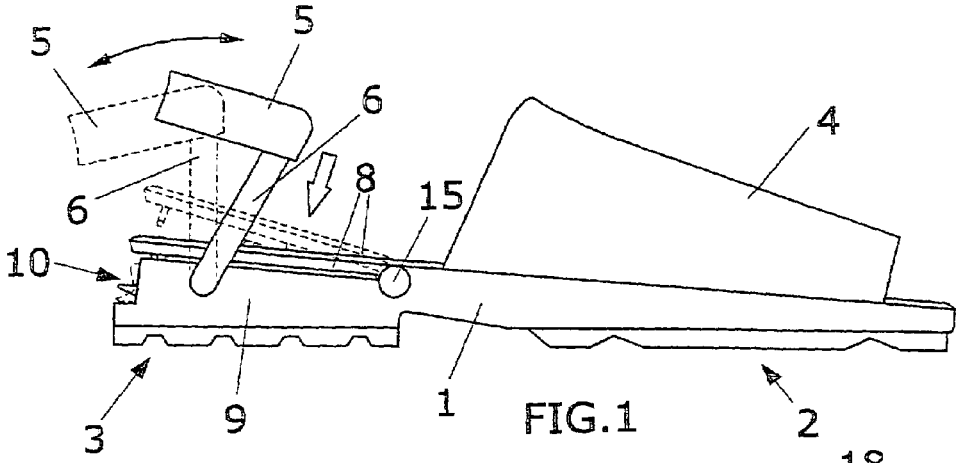
FIG. 1 is a side elevation view of the shoe according to a first example of embodiment of the invention.

Firstly making reference to FIG. 1, a first example of embodiment is shown of the shoe with automatic closure of the present invention that is comprised of a sole (1) which has a toe piece (2) to which is attached at least one front attachment element (4) meant to attach a front part of the foot, and a heel piece (3) to which is connected at least one rear attachment element (5) to hold part of the heel of the foot. This rear attachment element (5) is joined to or is part of at least one mobile support (6) that can move from an open position (shown in a discontinuous line), in which the rear attachment element (5) is separated from the aforementioned part of the heel of the foot, and a closed position in which the rear attachment element (5) is holding the heel of the foot. The mobile support (6) is related to a mechanism housed in the heel piece (3); this mechanism can be actuated by the user's foot heel pressing down on the heel piece (3) to move the mobile support (6) from the open to the closed positions mentioned above, as well as opened by the action of the other foot of the user on a member (10) of the mechanism to move said mobile support (6) from the closed to the open position.

Although FIG. 1 shows the shoe as a sandal, the invention is equally applicable to a shoe that is more closed, whether for indoor use as a slipper or outdoor use as a winter shoe, as will be described later with reference to FIGS. 9 and 10.

The aforementioned heel piece (3) is comprised of an upper element (8) and a lower element (9), hinged to each other by a hinge pin (15) so that they can move relative to each other. Said upper and lower elements (8, 9) are separated from each other in the open position of the mobile support (6) and the rear attachment element (5) and next to each other in the closed position. Advantageously, the lower element (9) is joined to the toe piece (2) of the sole (1) and the upper element moves upwards with respect to said toe piece, as shown in FIGS. 1–7 and 9–10. However, the upper element (8) can be joined to the toe piece (2) of the sole (1) such that it is the lower element (9) that moves downward with respect to it, as shown in FIG. 8. Additionally, the mechanical parts of the upper and/or lower elements (8, 9) can be mounted on corresponding supports with relatively thin rigid walls that are in turn attached to further corresponding elements that complete the shapes of the upper and lower elements of the heel piece (3) of the shoe having the properties usually required for them, such as a padded upper lining (28) for the upper element (8) and a rubber pad (29) for the lower element (9), possibly with cavities to reduce its weight, as well as a rubber sole (30). Thus, the upper and lower elements (8, 9) together with their mechanisms can be manufactured as a separate module that can be incorporated to shoes of various shapes and sizes.

FIGS. 2 to 5 show in detail the shoe mechanism and operation according to the first example of embodiment. This mechanism comprises elastic means (7) that push the mobile support (6) to the open position and first reversible retaining-release means (10) that retain the mobile support (6) in the closed position against the action of the aforementioned elastic means (7), which in turn act as second retaining means to keep the mobile support in the open position. The mobile support (6), which in the figures includes a pair of outer arms, is fixedly attached to a shaft (11) mounted on the lower element (9) so that it can turn a certain angle between the open and closed positions. Alternatively, the rear attachment element (5) and the moving support (6) may both be integrated in a single part joined to the shaft (11). Also fixedly joined to the shaft (11) is a lever (13) placed on a central part of the lower element (9) and provided with a distal end (14) that is slidably in contact with the upper element (8). The elastic means (7) comprise a helical spring in compression with one end in a housing of the lower element (9) and the other end acting on the aforementioned lever (13) to push the mobile support (6) towards the open position and, as a result of the sliding contact with the upper element (8), to separate the upper and lower elements (8, 9). With, this arrangement, when the user presses on the upper element (8) with the heel of the foot the distal end (14) slides on the upper element (8) while the latter approaches the lower element (9), so that the mobile support (6) moves towards the closed position against the action of the elastic means (7) until reaching the closed position, where it is automatically retained by the retaining means (10). In the closed position, the lever (13) and the spring (7) are housed in a cavity (46) of the lower element (9).

Figure 2A:
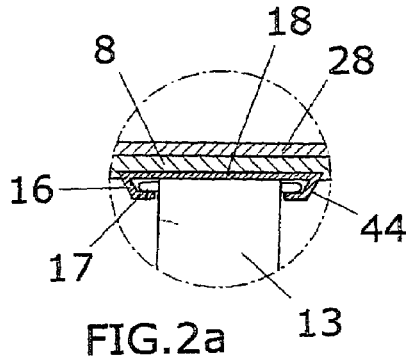
FIG. 2*a* is a detailed cross-sectional view of the guide means for the lever of the mechanism of FIG. 2.

Making reference to the detail of FIG. 2*a*, the upper element (8) includes guiding means (16) for the aforementioned distal end (14) of the lever (13). These guiding means limit a possible lateral relative motion of the upper and lower elements (8, 9) and a separation motion of the distal end (14) with respect to the upper element (8). The guiding means comprise at least one pair of grooves (16) facing each other, shaped or attached to the upper element (8), in which are slidably inserted the corresponding lugs (17) (see also FIG. 4) that project laterally out of the distal end (14) of the lever (13). In the figures, this distal end (14) is rounded and slides on a contact track (18) made of a strong material with a low coefficient of friction with respect to the material of the distal end (14) of the lever (13). The contact track (19) and the grooves (16) can be made from a single piece bolted, adhered or embedded in the upper element (8). Alternatively, mounted on the distal end (14) can be rolling components such as small wheels, or one or more rollers (not shown).

Alternatively, the lugs of the distal end (14) can be replaced by a shaft sufficiently long to project out of the left and right side ends of the upper mobile element (8) and join the side arms or the mobile support (6).

The shaft (11) also includes an eccentric protrusion that meets a surface (33) of the lower element (9) (see also FIG. 4) so that it limits the opening of the mobile support (6) and the separation of the upper and lower elements (8, 9). Alternatively, this limitation can be provided by a stop (not shown) on the guiding means (16).

Figure 3:
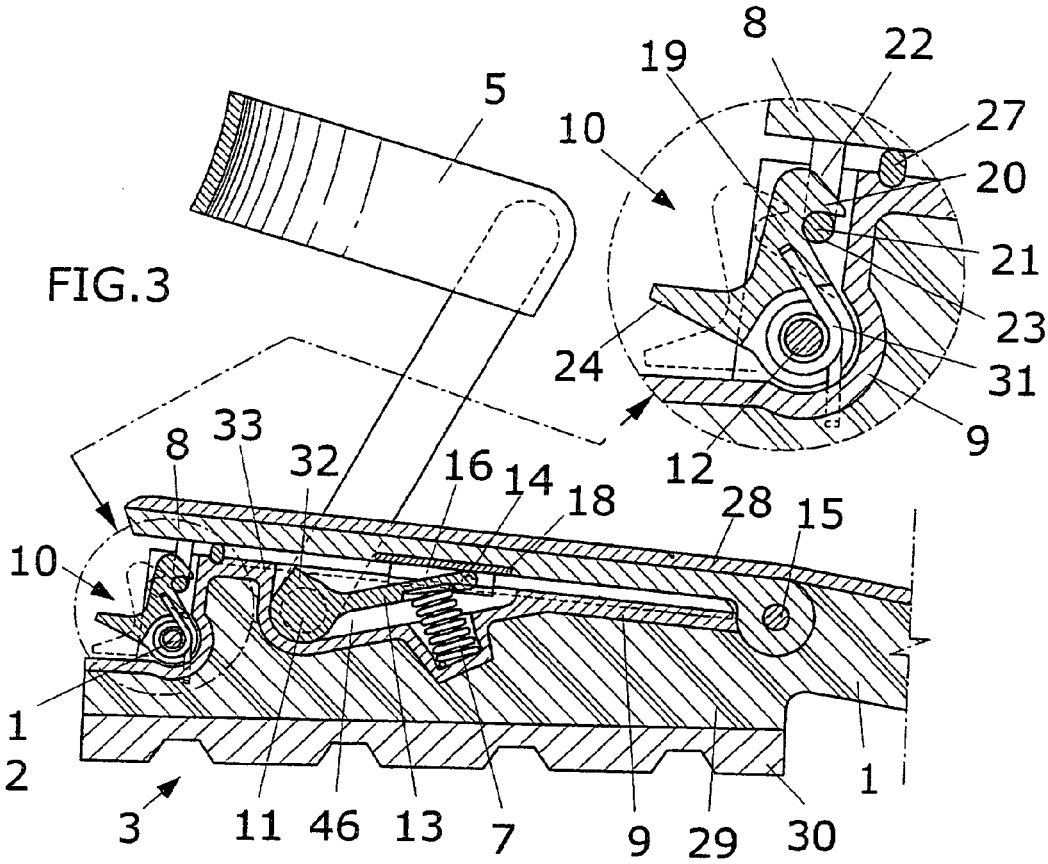
FIG. 3 is a longitudinal section view similar to that of FIG. 2 yet in a closed position, and includes an enlarged detail of retaining-releasing means.

The aforementioned retaining means (10), best seen in the enlarged detail of FIG. 3, comprise a trigger (19) mounted on the rear of the lower element (9) so that it can turn about a pin (12) and it is pushed by a spring (31) towards a retention position. The trigger (19) has a tab (20) on the upper part of which is disposed an inclined surface (22). Projecting out from beneath the upper element (8) is an anchoring (21) whose lower part has a surface (23) which, when the upper element (8) moves toward the lower element (9), acts as a pusher that contacts the inclined surface (22) and displaces the trigger (19) against the force of the spring (31) to allow the anchoring (21) to pass before the tab (20). When the mobile support (6) reaches the closed position and the upper and lower elements are in contact, the tab (20) is automatically engaged by the anchoring (21) as a result of the action of the spring (31) (see FIG. 5). The trigger (19) also comprises a protrusion (24) that is accessible from the outside and that can be actuated by the user when the mobile support (6) is in the closed position to displace the trigger (19) against the action of said spring (31) in order to release the tab (20) from the anchoring (21) allowing the mobile support (6) to move to the open position by the elastic means (7). The aforementioned protrusion (24) is prevented from projecting out of the maximum boundary of the show to prevent an involuntary opening of the mechanism.

Alternatively, the inclined surface can be placed on the upper element (8) instead of on the trigger (19). The spring (31) (see also FIGS. 4 and 5) can for example be a helical torsion spring mounted around the pin (12) with its ends respectively inserted in orifices of the trigger (19) and the lower element (9). FIG. 5 also shows the inclined side ends (47) of the anchoring (21) that in the closed position are inserted in the inclined walls (37) of a cavity (43) present in the opposite lower element (9) where the trigger (19) is housed, thereby providing centring and transverse locking means for the upper element (8) with respect to the lower element (9). Similar centring and transverse locking means can be obtained by incorporating inclined surfaces (44) in the side ends of the grooves (16) (see FIG. 2*a*) disposed to be inserted in the closed position in inclined lateral surfaces (45) (see FIG. 4) of the cavity (46) of the lower element (9) where the lever (13) and the spring (7) are housed in the closed position.

Figure 4:
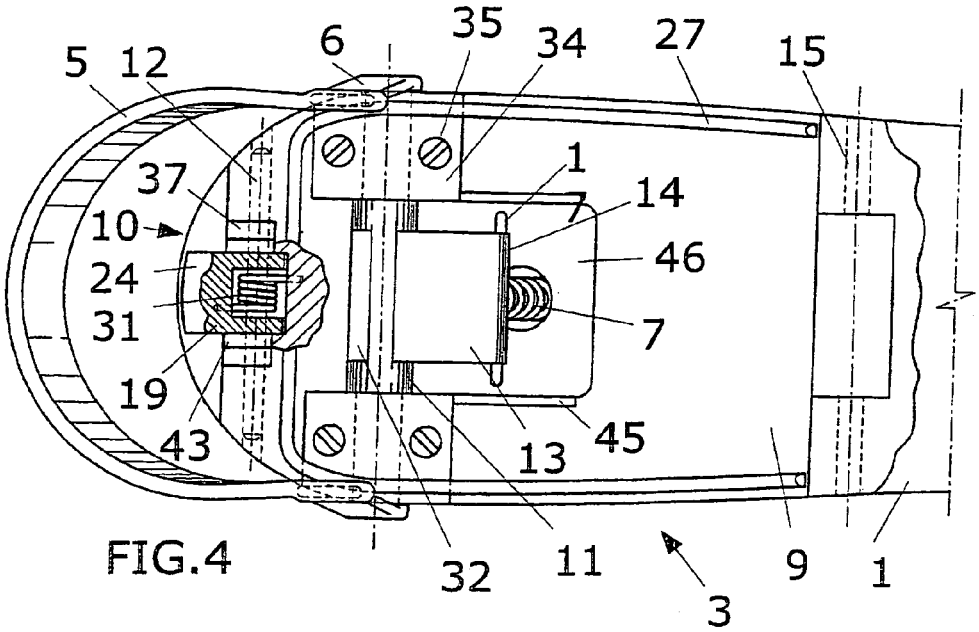
FIG. 4 is a plan view of the heel piece of the shoe of FIG. 1 with the upper element removed to show the mechanism more clearly.
Figure 5:
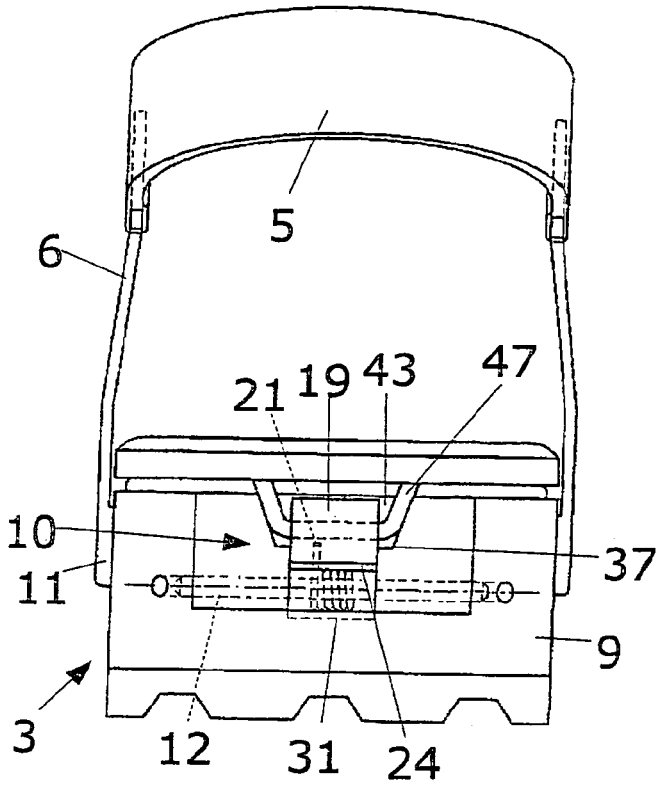
FIG. 5 is a rear view of the shoe of FIG. 1 in the closed position.

A waterproof gasket, best seen in FIG. 4, is placed along the perimeter of the lower element (9), although it could also be on the upper element (8), so that it establishes a protective seal for the mechanism when the upper and lower elements (8, 9) are near each other, in contact, in the closed position. The aforementioned waterproofing gasket (27) is in the form of a cord made of an elastic material that is partially inserted in a groove dug out of an upper surface of the lower element (9), providing sufficient elasticity to allow the trigger (19) to open and close. The shaft (11) is housed in a cavity with a rounded base transverse to the lower element (9) and is held in position by a pair of small covers (34), supported for example by bolts (35). These covers can have a bottom configuration (not shown) able to cooperate, optionally aided by friction bushings, with guiding the shaft (11) and grooves on the top that connect with and establish continuity with the aforementioned groove of the upper surface of the lower element (19) for the waterproof gasket (27).

Figure 6:
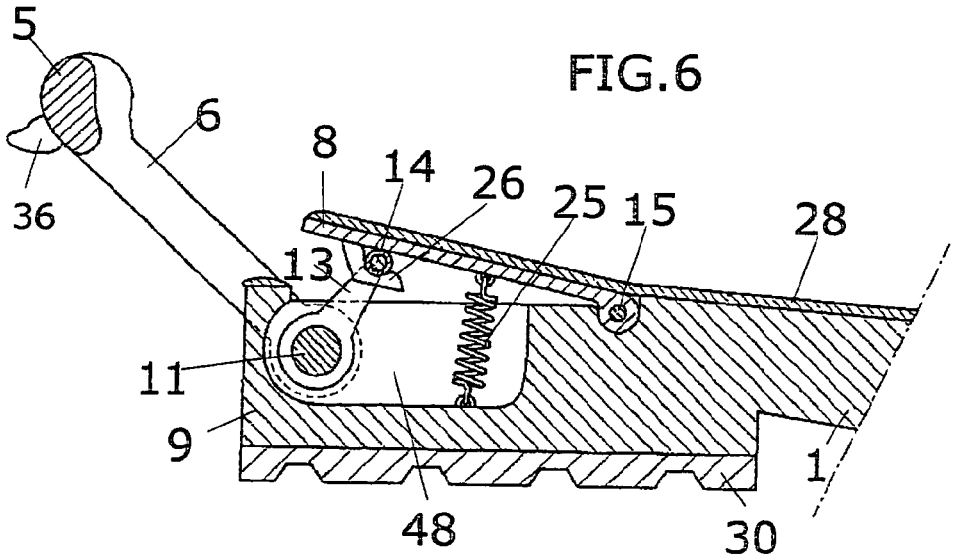
FIGS. 6 and 7 are partial longitudinal section views showing the heel part of the shoe according to a second example of embodiment of the invention.
Figure 7:
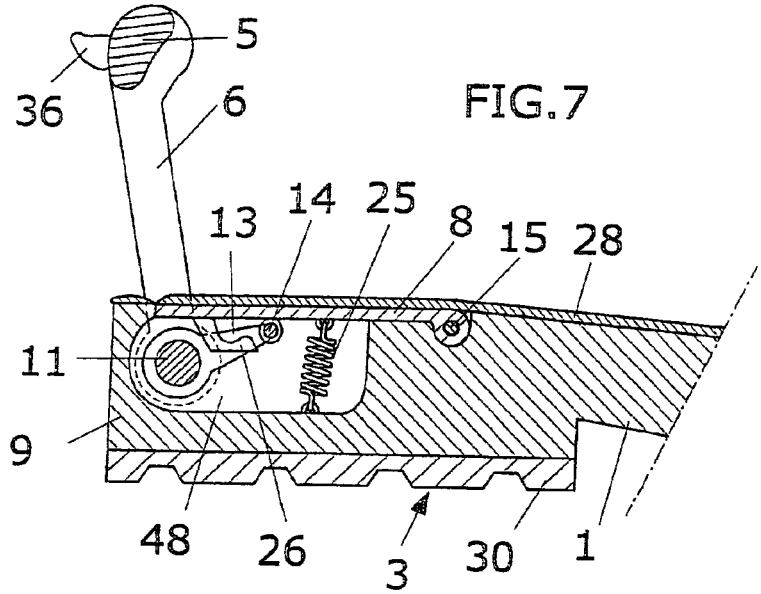
Figure 8:
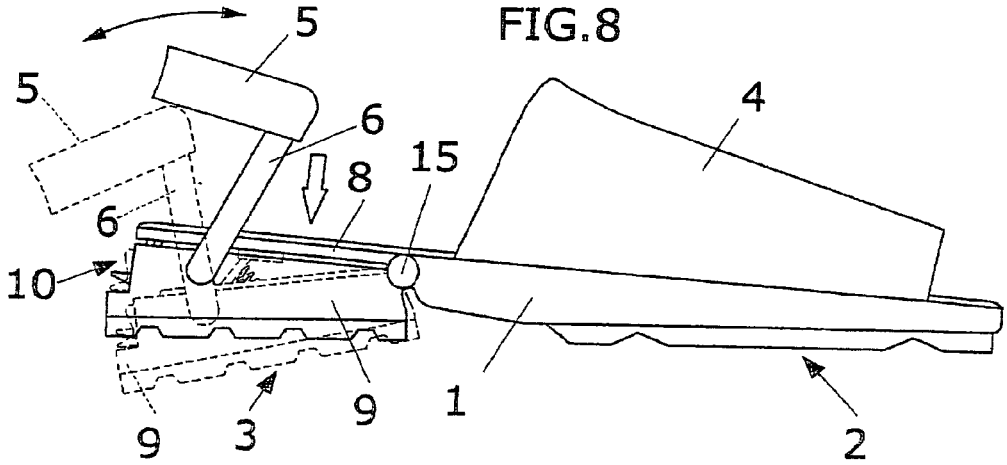
FIG. 8 is a side elevation view of the shoe according to a variant of the example of embodiment of FIGS. 1 to 5.

FIGS. 6 and 7 show a second example of an embodiment of the invention in which the mechanism includes elastic means (25) that push the mobile support (6) towards the closed position, which act as a first retaining means to keep the mobile support (6) in the closed position and second reversible retaining-releasing means (26) that retain the mobile support (6) in the open position (FIG. 6) against the action of the aforementioned elastic means (25). Said retaining-releasing means are configured and arranged in relation to the upper and lower elements (8, 9) so that when the upper element (8) is pressed on by the heel of the user's foot n order to bring it near the lower element (9), the retaining means (26) are returned to a position releasing the aforementioned mobile support (6) so that it can move to the closed position (FIG. 7) by the action of the elastic means (25). As in the previous example of an embodiment the mobile support (6) is fixedly attached to a shaft (11) mounted trough a cavity (48) of the lower element (9) so that it can revolve about a given angle between the open and closed positions, a lever (14) also being fixedly attached to the shaft (11) in sliding or rolling contact with the upper element (8). However, the elastic means (25) have the form of a helical traction spring that attracts the upper element (8) to the lower element (9). The second retaining means (26) have the form of an elastic finger joined to the upper element (8) that defines a narrowed opening to a housing in which is inserted a transverse pin mounted on the distal end (14) of the lever (13), also acting to limit the extent to which the mobile support (6) opens and the upper and lower elements (8, 9) separate.

Figure 2:
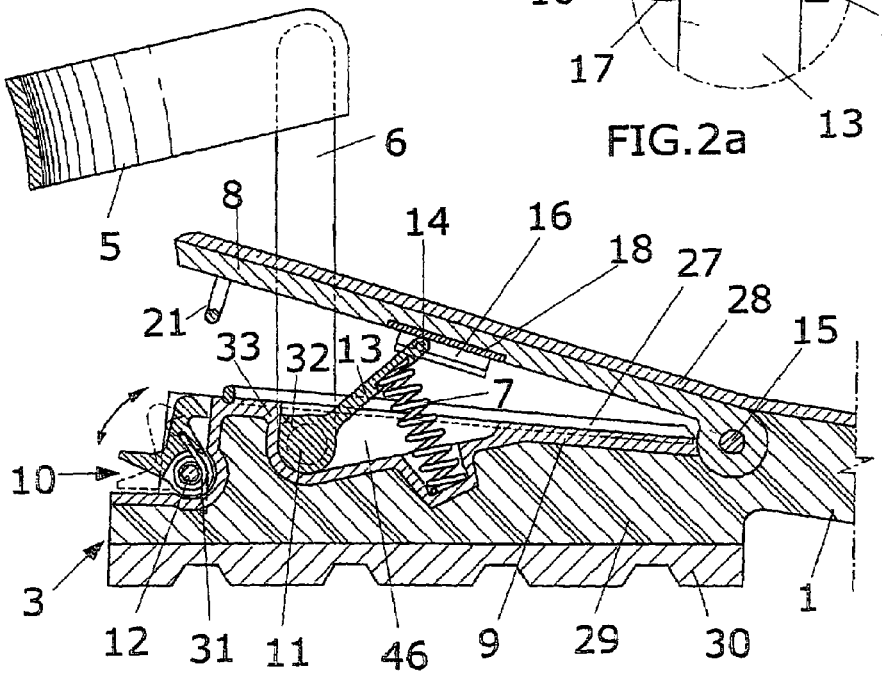
FIG. 2 is a longitudinal section view of the heel piece of the shoe of FIG. 1 in the open position.

Here, unlike the first embodiment example shown in FIGS. 1 to 3, to open the shoe the mobile support (6) can be displaced by the user, for example with his/her other foot, from the closed position to the open position against the resistance of the elastic means (25). For this the spur (36) projecting from the rear attachment element (5) can be used. In this displacement the lever (13) causes the separation of the upper and lower elements (8, 9) until the distal end (14) is caught by the elastic finger of the retaining means (26), so that these elements are automatically placed in a position retaining the mobile support (6) in the open position. (FIG. 6).

Figure 9:
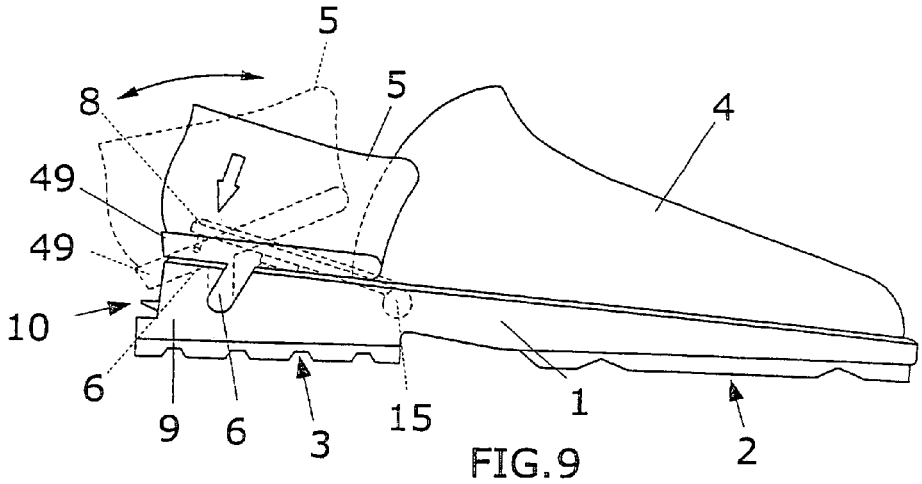
FIG. 9 is a side elevation view of the shoe in a closed version using the mechanism of the example of embodiment of FIGS. 1 to 5.

FIG. 9 shows a shoe provided with a mechanism analogous to the first example of embodiment shown in FIGS. 1 to 5, except that in the closed position the front attachment element (5) reaches an external edge of the sole and envelopes the shoe heelpiece. For this purpose, the mobile support (6) is joined to an arc-shaped piece (49) that embraces from the rear the bottom edge of the rear attachment element (5), which, in the closed position, adopts a position very near the outer edge of the sole in order to provide as tight a seal as possible, and a front edge partially overlaps the front attachment element (4). Alternatively, the mobile support (6) can have the form of front arms and the rear attachment element (5) can have a rear area (not shown) sown or glued onto the outer rear edge of the heel piece (3) and be of a sufficiently flexible material to wrinkle in the open position. Advantageously, the upper element (8) does not encompass the entire upper surface of the heel piece (3) but instead is configured as the button that in the open position projects out of the lower element (9), which is joined to the rest of the sole.

Figure 10:
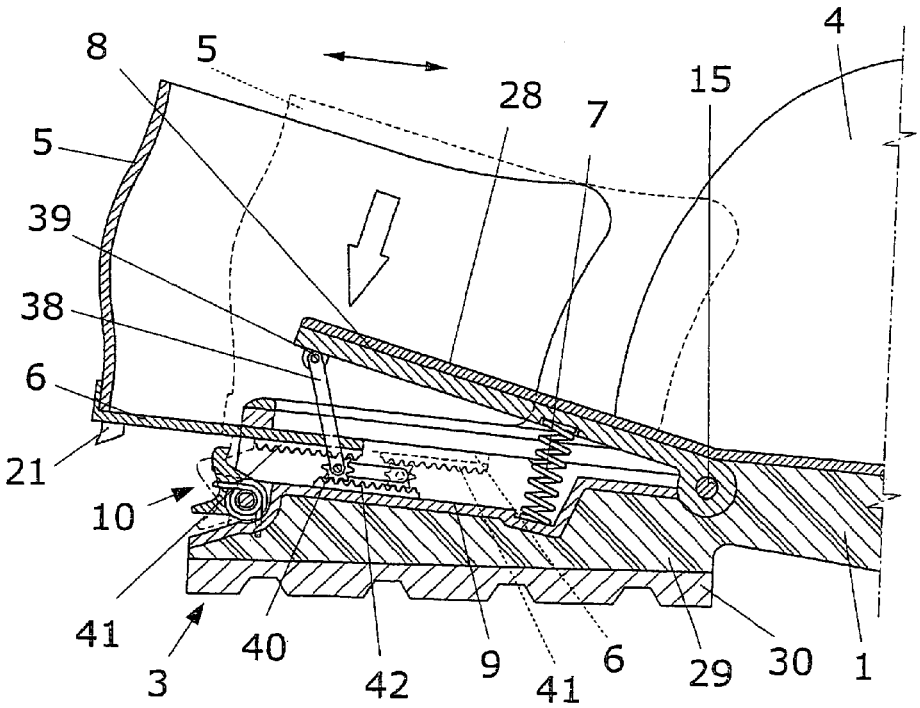
FIG. 10 is a partial longitudinal section view of the shoe in a closed version using a variant of the mechanism of the example of embodiment of FIGS. 1 to 5.

Finally, with reference to FIG. 10, an example of embodiment is shown alternatively suited for a closed shoe adequate for the winter, as the mobile support (6) is displaced linearly guided with respect to the lower element (9). A lever (38) is hinged on one end (39) with respect to the upper element and is coupled on the opposite end to at east one gearwheel (40) that at diametrically opposite parts engages two parallel and opposing racks (41, 42), respectively attached to the mobile support (6) and to the lower element (9). Here the function of the releasable second retaining means is performed by a helical spring (7) that pushes the mechanism towards the open position, and the first releasable retaining means (10) retain the mobile support (6) in the closed position. Thus, the rear attachment element (5) travels a distance that is twice as long as the end of the lever (38) in which the gearwheel (40) is mounted, and the front and rear attachment elements (4, 5) can suitably overlap. The first retaining means (10) are very similar to those described with reference to FIG. 3, except that here the anchoring (21) is attached to the mobile support (6) instead of to the upper element (8).

In the alternatives of FIGS. 9 and 10, the front attachment element (4) can include, as is usual in closed shoes, conventional tightening means such as strings, straps with buckles, Velcro strips and the like, which are only used to establish an initial adjustment as the invention allows to put on and take off the shoes without unlacing them.

Figure 11:
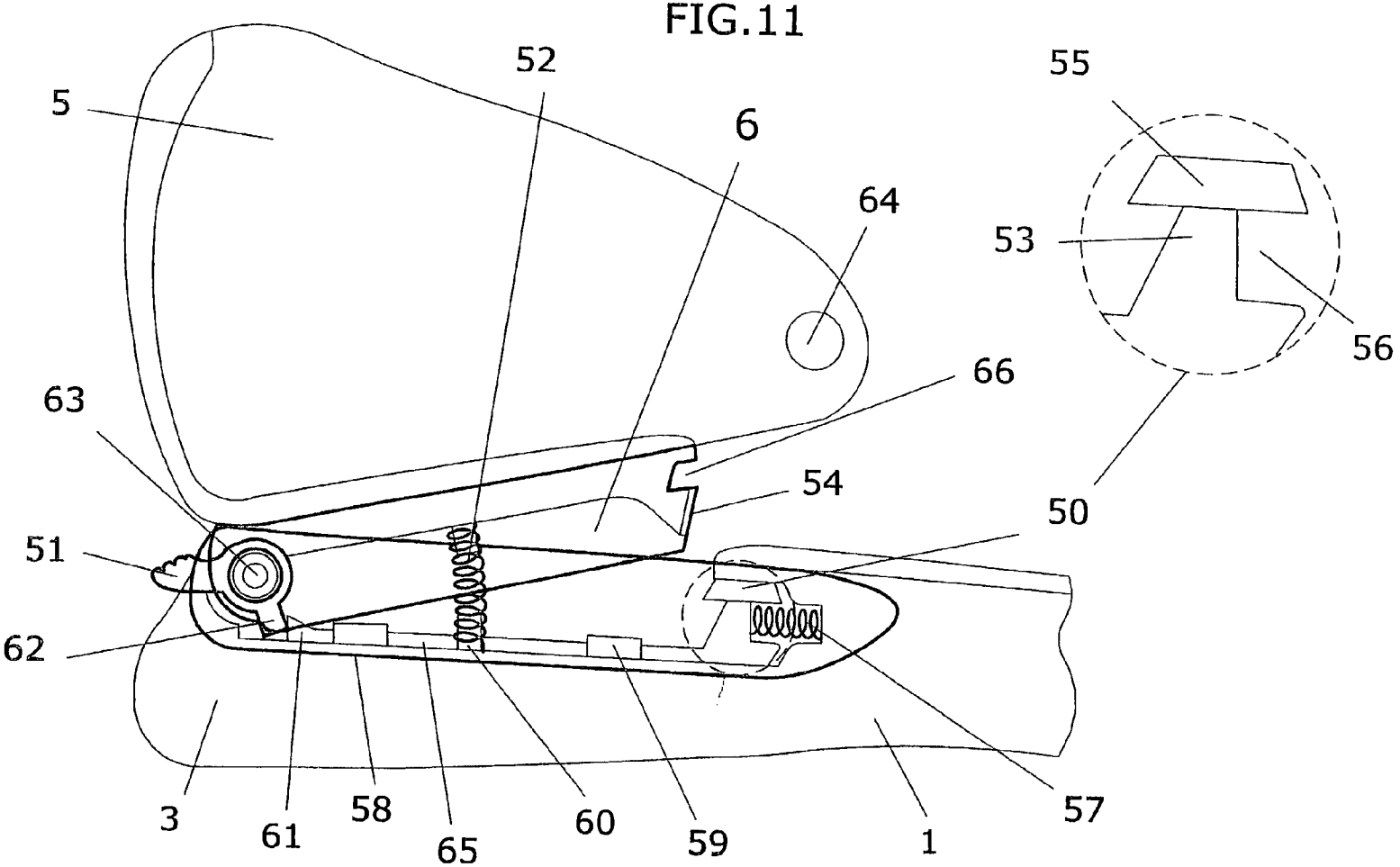
FIGS. 11 and 12 are a representation of another embodiment different from that of the preferred example, FIG. 12 being a variant of the former.
Figure 12:
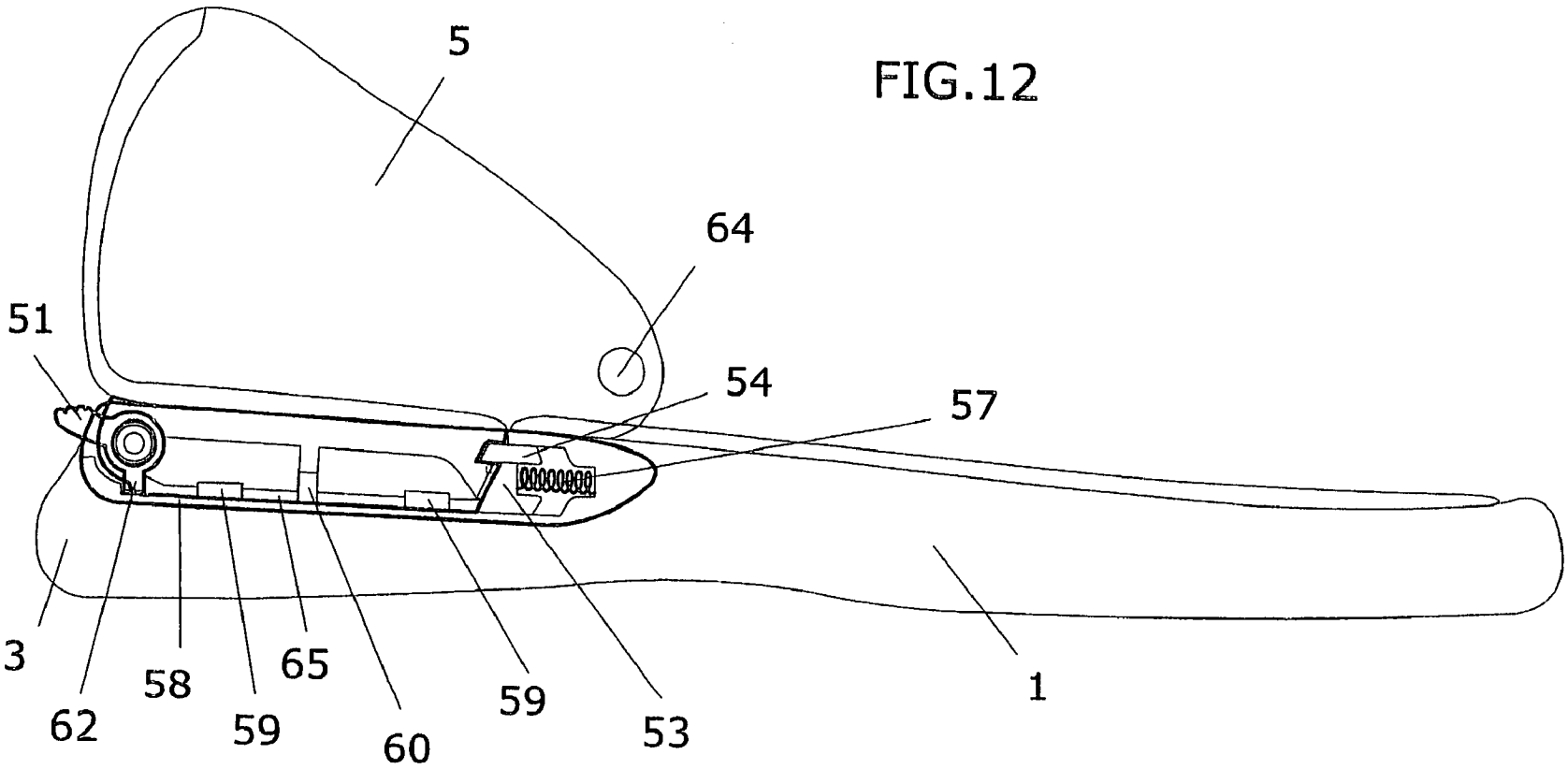

FIGS. 11 and 12 show a different embodiment based on the same shoe principle, that comprises a sole having a toe piece to hold the front part of the foot, a heel piece to which is connected a rear attachment element, this rear attachment element being coupled to a mobile support that can move between a closed and an open position. The mobile support is also coupled to a mechanism housed in said part of the heel, having first and second retaining-releasing means that respectively keep the mobile support in the closed and open positions.

FIG. 11 shows the rear attachment element (5) in its open position, separated from the heel piece, keeping this position by the retaining means (52). The assembly is provided with retaining-releasing means (50) that maintain the attachment element (5) in a closed position, said retaining means being released by the releasing means (51).

The assembly formed by the rear attachment element (5) and the mobile support (6) are firmly coupled, the assembly being hinged at its rear by a hinge (63) attached to the rear part of the heel (3) of the sole (1).

On the heel (3) of the sole (1) there is a hollow space (58) that houses a piece with a mobile base (65) that can move horizontally towards either the front part or the rear part of the shoe. This piece with a mobile base (65) runs inside the space (58) being guided by guiding means (59) emerging from the space (58) that act as displacement guides.

The forward displacement of the mobile base (65) results from a force exerted on the mobile base (65) by the release actuation piece (51); this displacement takes place against the elastic means (57) to compress them, so that when the release actuation piece (51) is not longer being acted on the mobile base (65) moves towards the rear part due to the elastic means (57).

In addition, the release actuation piece (51) is provided with a lug (62) such that when it turns about the pivoting shaft (63) it will move the lug, pushing the end protrusion (61) of the mobile base (65) to move it forward.

Furthermore, and in object to aid the separation and elevation of the assembly formed by the rear attachment element (5) and the mobile support (6) and maintain it in said position, an elastic means (52) is provided between the attachment elements (60) provided in the mobile base (65) and another on the mobile support (6). The displacement towards said position is conditioned by the pressure exerted on the release actuation piece (51) until the retaining effect of the retaining means (50) is reversed and the mobile base (6) is released to reach its open position, pushed by the elastic retaining means in an open position (52).

The retaining-releasing means (50) are disposed on the front end of the mobile base (65), and comprise an emerging lug (53) that is provided on its upper end with a projection (55) with a bevelled edge that can be housed in the recess (66) defined in the mobile support (6) that is firmly attached to the rear attachment element (5). Defined in this reversible retaining-releasing means (50) is an incut (56) on which acts one of the ends of the elastic means (57).

On the lower part of the recess (66), the edge (54) is inclined in order to transmit a movement to the remaining-releasing means (50) towards the front part of the shoe and later allow housing the projection (55) in the recess (66).

FIG. 12 shows the previous closed embodiment in which when mobile base (65) is no longer pressed on by the lug (62) of the release actuation piece (51) remains in its rear position due to the action of the elastic means (57), the upper projection (55) of the reversible retaining-releasing means (50) inserting itself in the recess (66) defined in the mobile base, so that despite the action of the elastic retaining means in the open position (52), it is not possible to proceed to the open position of the mobile base and the rear attachment element (5).

The rear attachment element is provided in its front part with an orifice (64) onto which is hinged a part of the front attachment means (4).

Alternatively to the arrangement of the retaining means in the open position (52) as shown in FIG. 11, it is possible to dispose elastic means in the hinge (63) such as a spring that acts on the assembly of the rear support (5) and mobile support (6).

Figure 13:
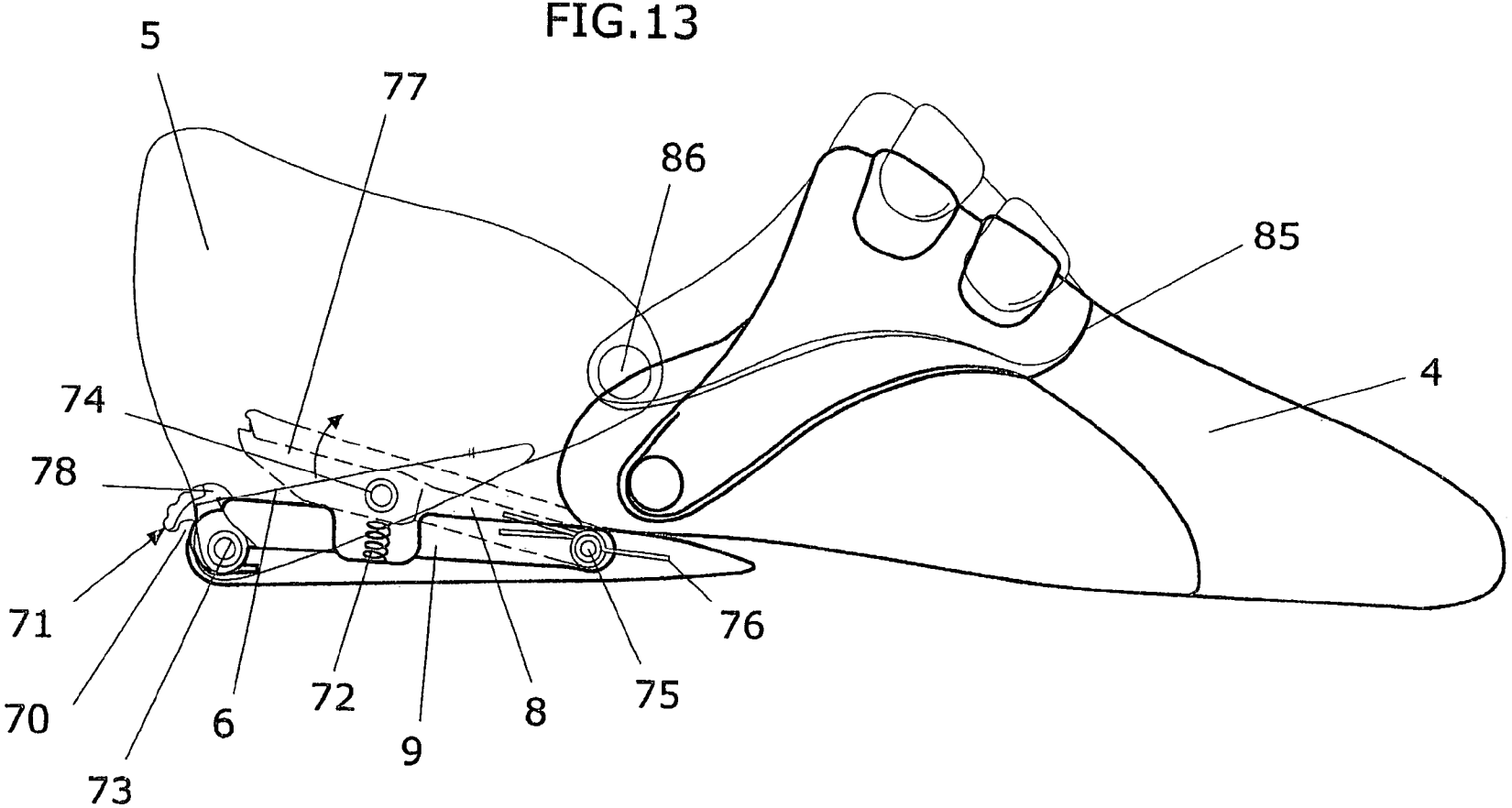
FIGS. 13, 14 and 15 are new variants, showing different positions of the spring, acting in a different way in each location.
Figure 14:
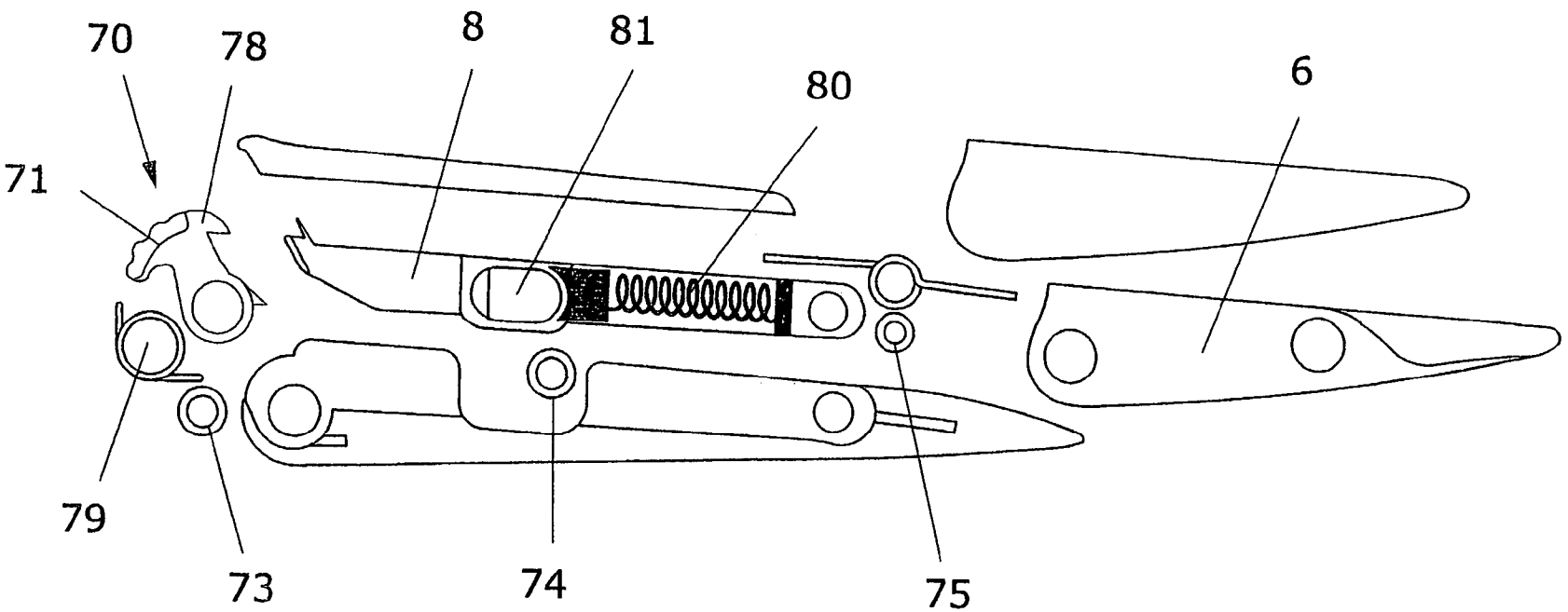
Figure 15:
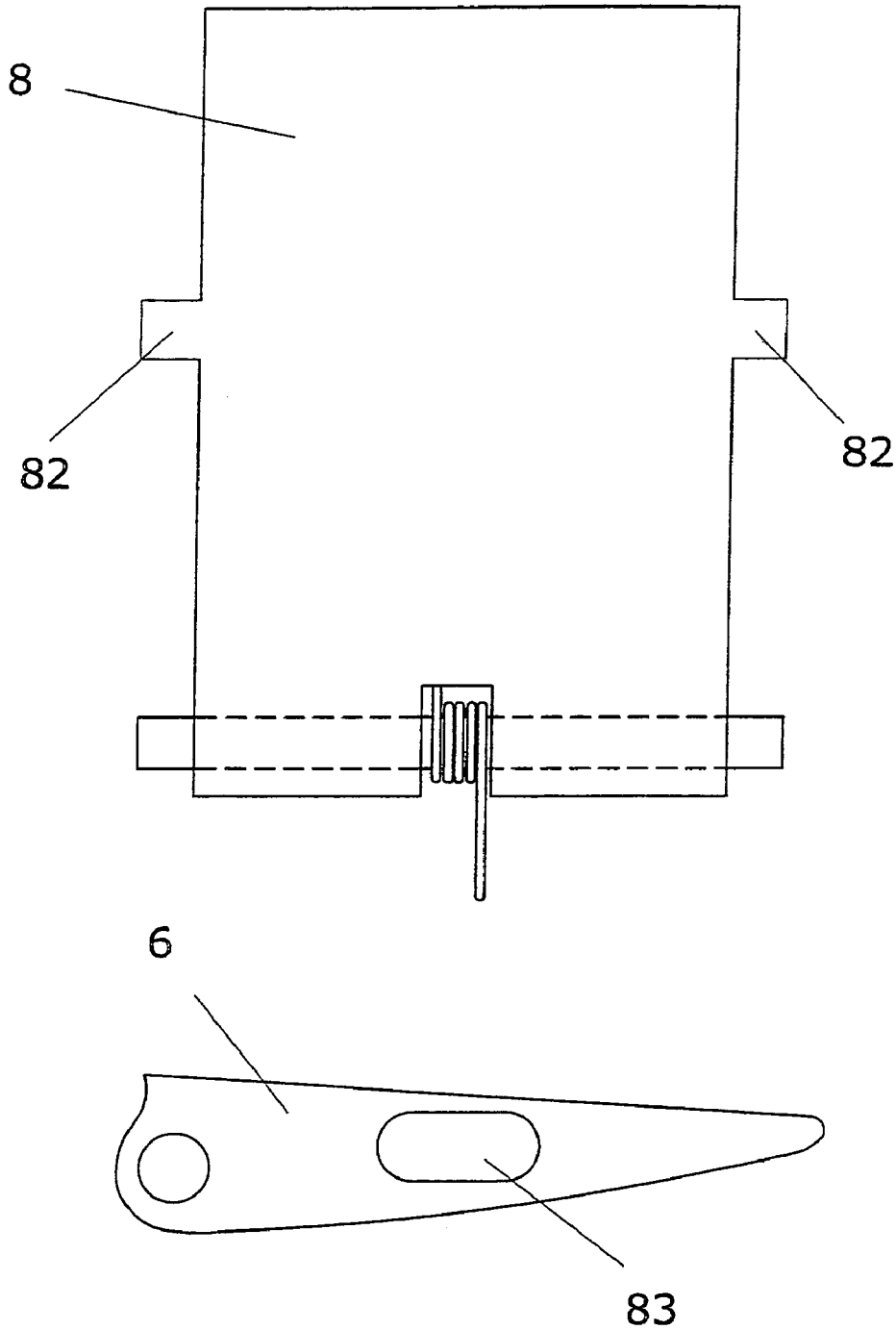

FIGS. 13 to 15 show another embodiment of the shoe with automatic closure object of the invention having three constructive alternatives, provided with a spring on the front shaft acting on the upper element, or with a vertical spring acting on the upper element, or with a horizontal spring placed on the upper element acting on the mobile support.

This form of embodiment shows the rear attachment element (5) firmly attached to a mobile support (6) that has two orifices allowing to pass the corresponding pivoting shafts, a rear pivoting shaft (73) and a central pivoting shaft (74). In addition, on the heel area is an upper element (8) and a lower element (9) hinged to each other by a front hinge (75), the upper element (8) also being hinged to the mobile support (6) by the central shaft (74).

The rear attachment element (5) and the mobile support (5) can be configures as a single part with the characteristics of the aforementioned parts.

As in the previous embodiments, the assembly is provided with reversible retaining-releasing means (70) that allow keeping the rear attachment element (5) in the closed position. These reversible retaining-releasing means (70) have an actuation tab (71) that, pressing against the action of a spring (79) (FIG. 14) and revolving about the rear shaft (73), displaces the flap (78) releasing the rear part (77) of the upper element (8) raising it by elastic means.

The opening of the rear attachment element (5) takes place together with the elevation of the upper element (8) as it rises from its rear part as it is hinged to the front hinge (75), by means of the action of the retaining-releasing means (70) and the action of one of following three forms of actuation:

- action of elastic means or spring (76) placed on the front shaft (75)
- action of vertical elastic means (72) disposed between the lower element (9) and the upper element (8) that in its displacement carries with it the shaft (74) in a circular motion centred on the rear hinge (73)
- or by a spring (80) horizontally disposed that acts on the central shaft (74)

FIG. 14 shows all of the parts comprising this embodiment, where worth mentioning are the upper part (8) provided with an elongated or oblong orifice (81) through which passes and slides the central shaft (74), due to the action of the retaining-releasing means (70) and that of one of the aforementioned elastic means (72), (76) or (80), the central shaft (74) moves inside the oblong cavity (81) defined in the upper element (8).

If the elongated or oblong-shaped orifice (81) through which slides the central shaft (74) does not exist, so that there is simply a pivoting shaft, the upper element would move when it rises, the front shaft having the oblong orifice.

FIG. 15 shows an alternative embodiment complementary of the ones previously discussed, that consists of providing the upper part (8) on its sides with corresponding lugs (82), eliminating the oblong orifice (81), these lugs being housed in elongated orifices (83) made in the mobile support (6) so that it allows hinging the mobile support (6) to the upper element (8), the side lugs (81) of the upper element sliding in said oblong orifice (83).

In addition, the rear attachment element (5) has an orifice on each side in which pivots a hinged part (84) of the front closed part (4). This front hinged part (84) is joined to the rear attachment element by a hinge (86). The hinged part (84) is also provided with a degree of freedom in its union to the front part (4) through the hinged area (85).

Alternatively to the hinged part (84) as shown, it is possible to configure it as a belt that moves sideways under guides, being retained in the hinges (86) so that when the assembly is closed when it moves downwards the hinge (86) pulls on the belt to press on the upper and improve its hold.

Another possibility is for the rear attachment element (5) to be directly hinged to the front part (4) by hinging means (86) without requiring any additional means.

Figure 16:
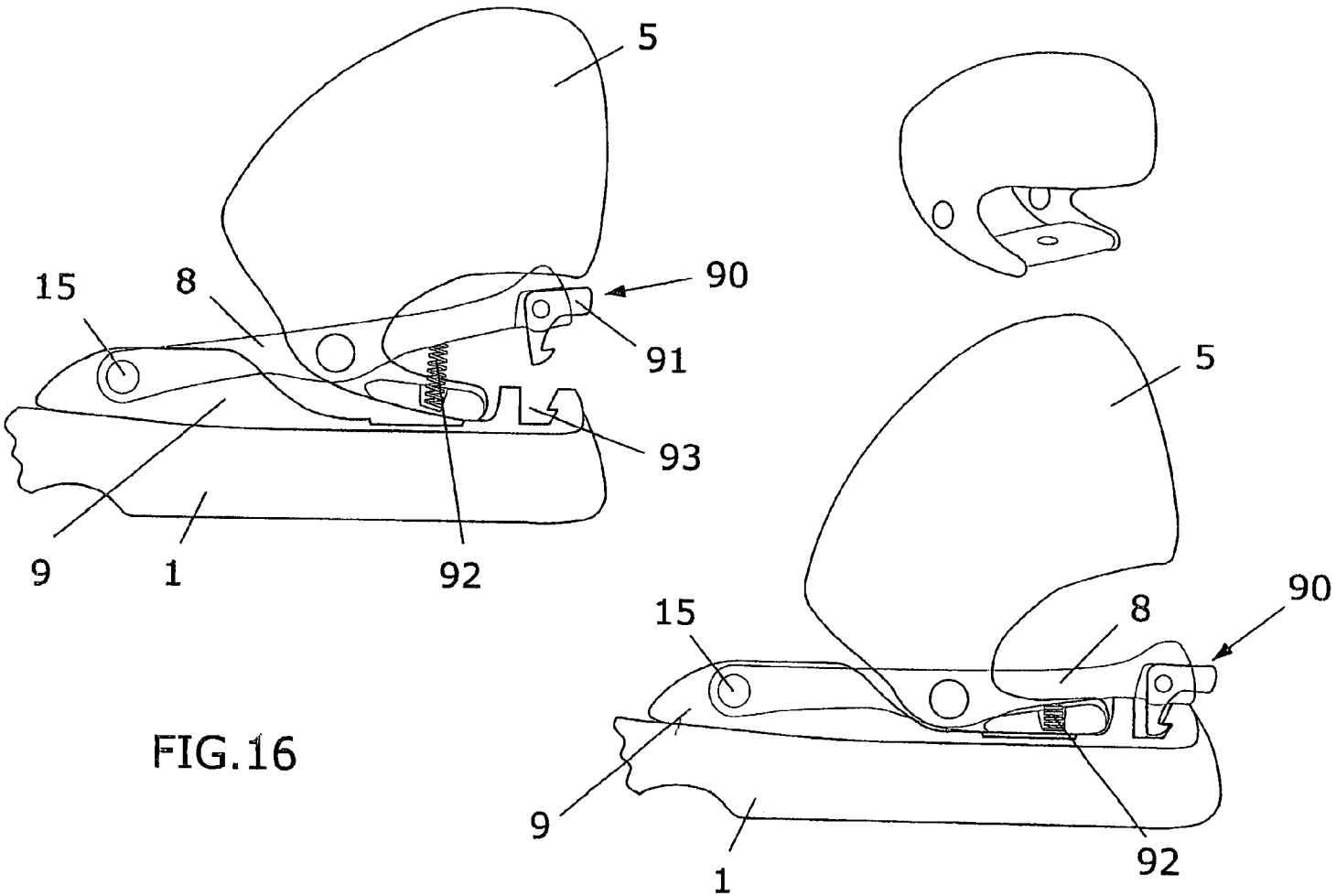
FIG. 16 shows a different example of embodiment.

FIG. 16 shows an embodiment in which the retaining-releasing means (90) actuated on a member trigger (91) are disposed on the rear part of the upper element (8), inserted in a recess (93) defined in the lower element (9), using elastic elements (92) or the like to retain the upper element in said position, being provided with the hinge of the rear attachment element 85) and the upper element (8) above it.

Figure 17:
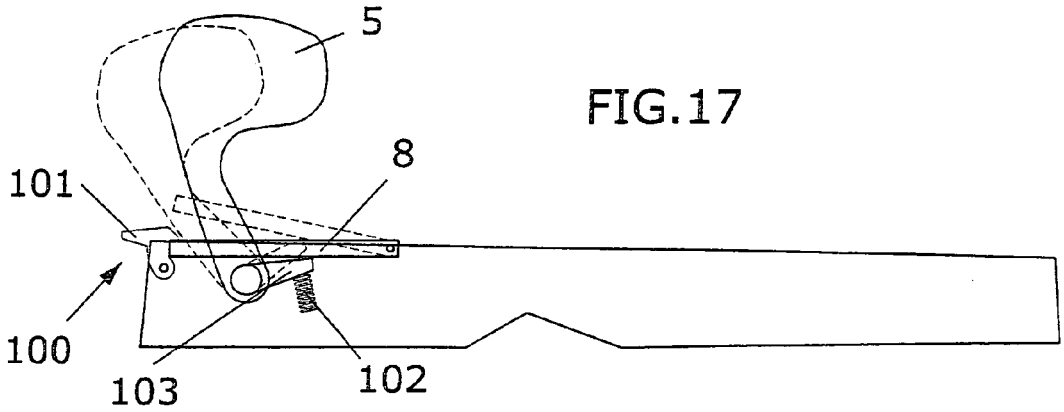
FIGS. 17 to 19 also show different embodiments based on the same principle.

FIG. 17 shows the retaining-releasing element (100) actuated on by the trigger (101) joined to the sole or to the lower element, the rear retaining element (5) using an arm (103) on which acts an elastic means (102) to retain it in said position.

Figure 18:
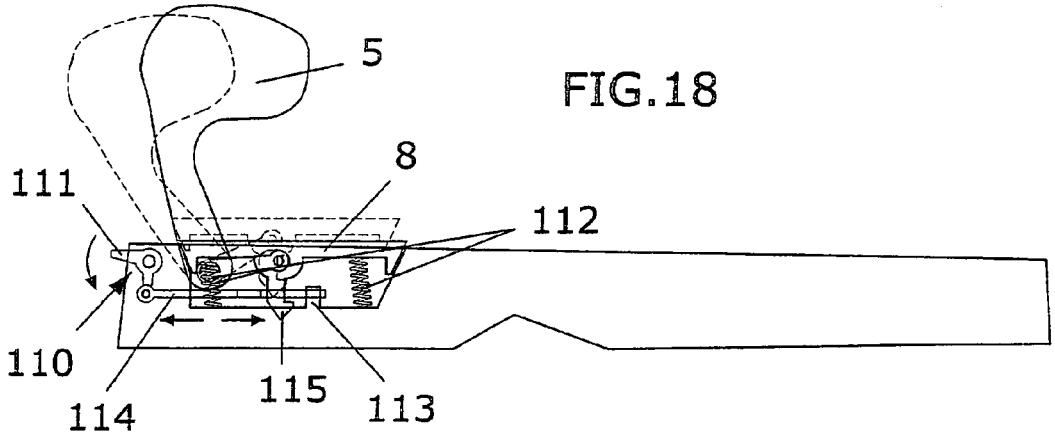

In FIG. 18, when the trigger or member (111) of the retaining releasing means (110) is acted on a part (113) is displaced above which is an orifice (114) that allows releasing a hook (115) of the upper element (8), lifting the upper element (8) by an elastic means (112).

Figure 19:
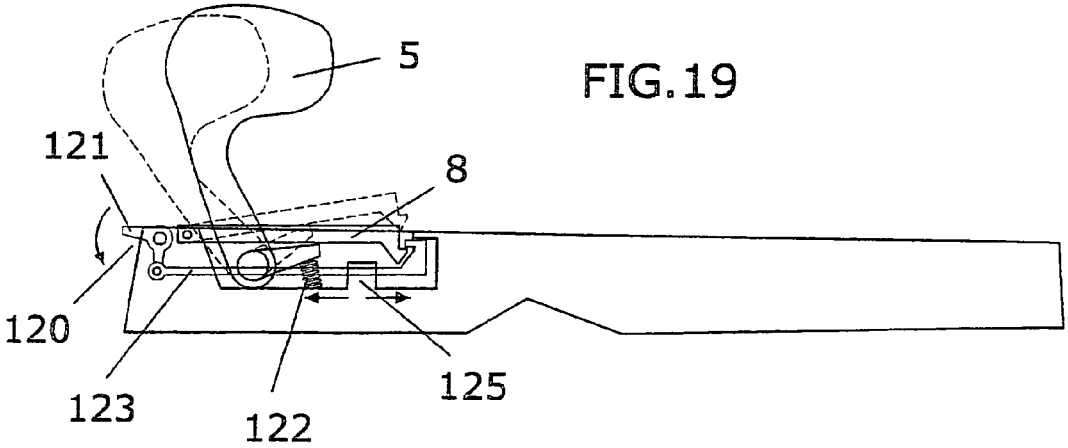

In FIG. 19 the operation is similar, having retaining-releasing means (120) actuated by a trigger (121) that moves an element (123) that releases a hook (125) placed above the end of the upper element (8). In the last two embodiments, when the show is opened or released there is a crack between the upper element and in show insole.

Figure 20:
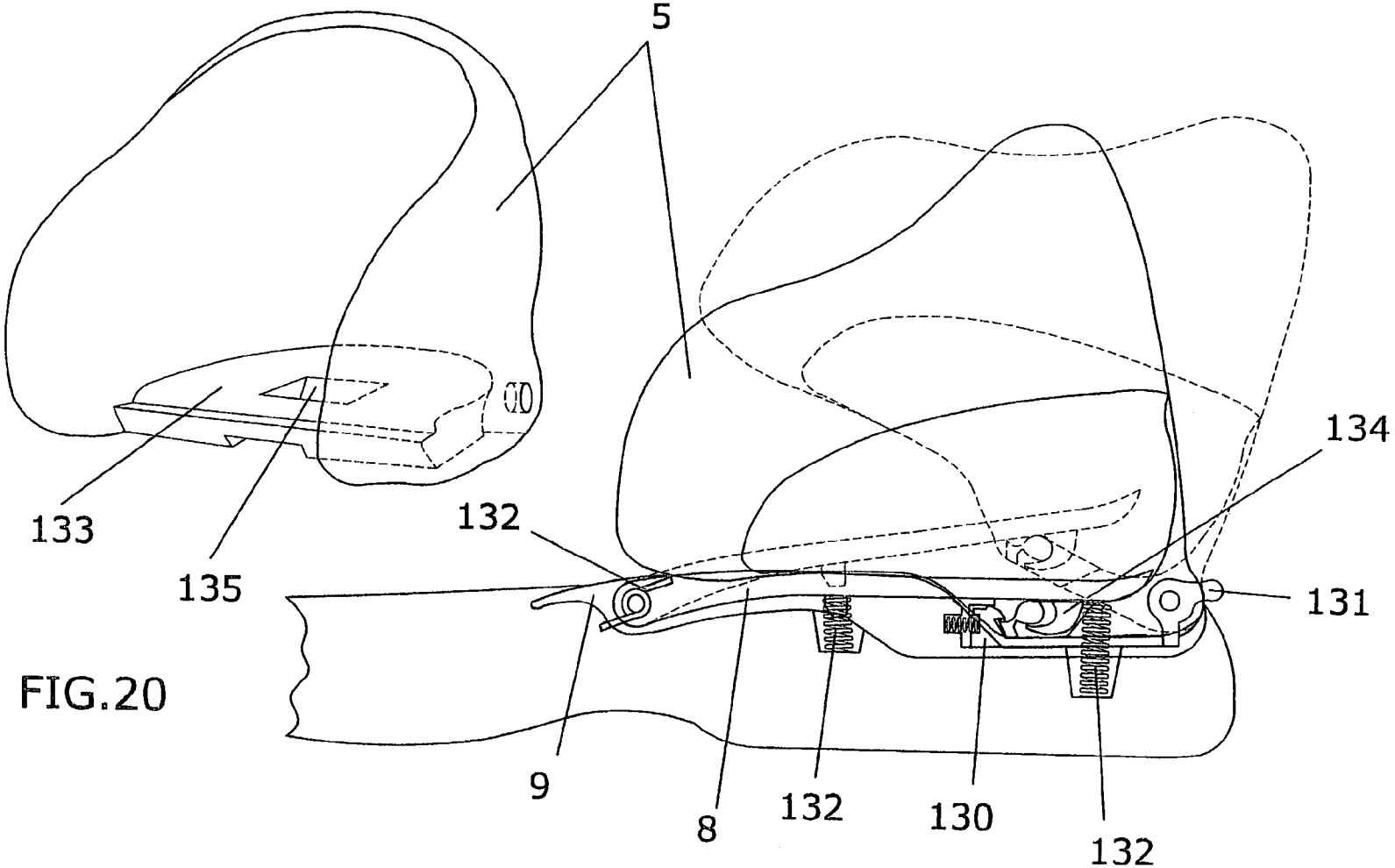
FIG. 20 shows an embodiment in which there is no central pivoting shaft.

FIG. 20 shows an embodiment similar to that of FIG. 17, in which the retaining-releasing means (130) are actuated by a trigger or element (131), these means being housed inside a space of the sole. In order to facilitate retaining and releasing the upper element (8), on the lower part of the rear retaining element (5) is provided an additional element (133) that does not require a central hinge and has a window (135) through which passes the hook (134) of the upper element (8), the parts (5) and (8) being connected. In the open position the upper element (8) is retained by elastic means (132).

Figures 21, 22:
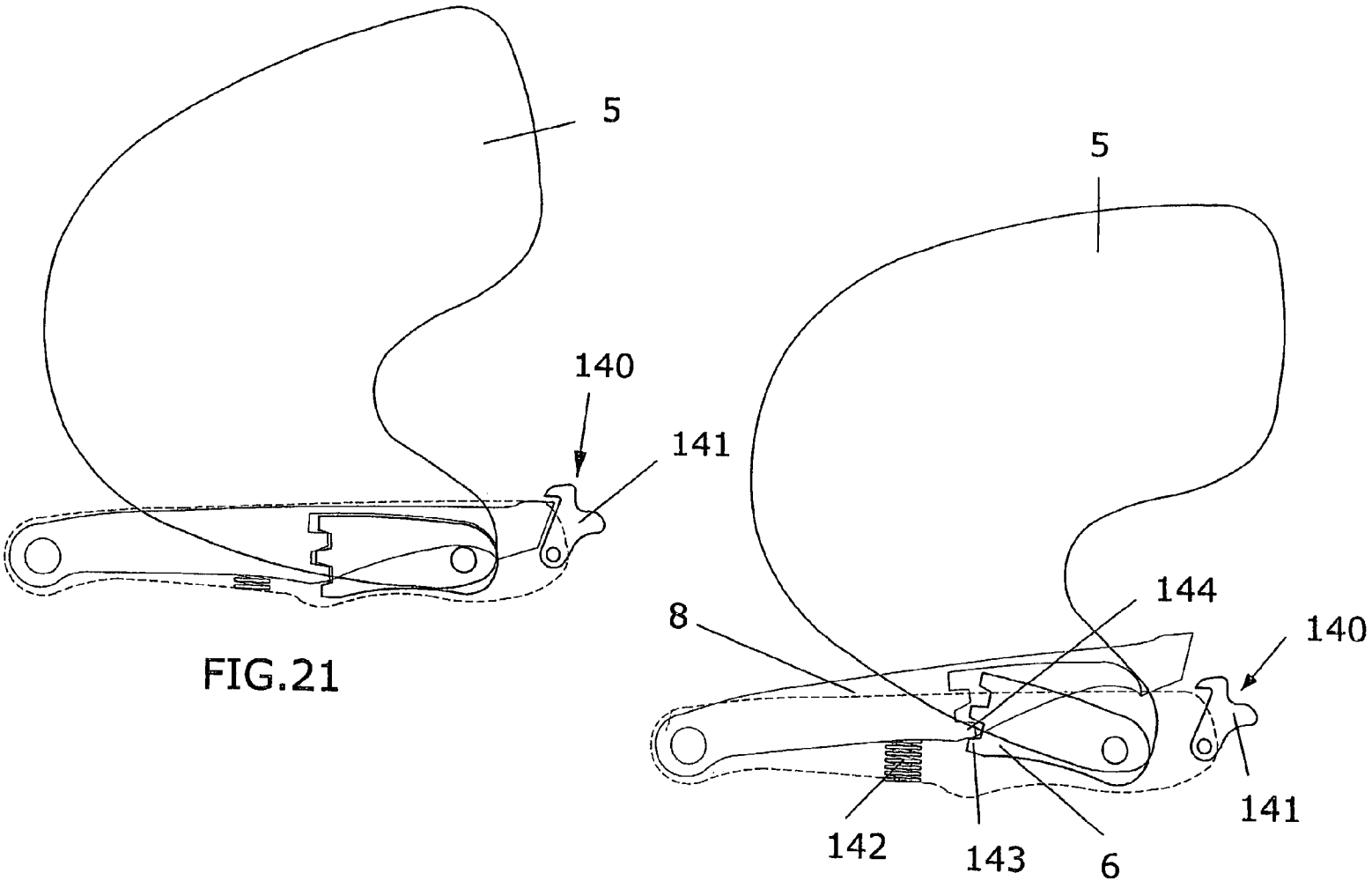
FIGS. 21 and 22 show another new embodiment.

The embodiments shown in FIGS. 21 and 22 are based on the engagement of the upper element (8) and the mobile support (6) that is joined to the rear attachment element (5). They are also provided with retaining releasing means (140) actuated by a trigger or element (140) and maintained in the open position by elastic means (142).

Figure 23:
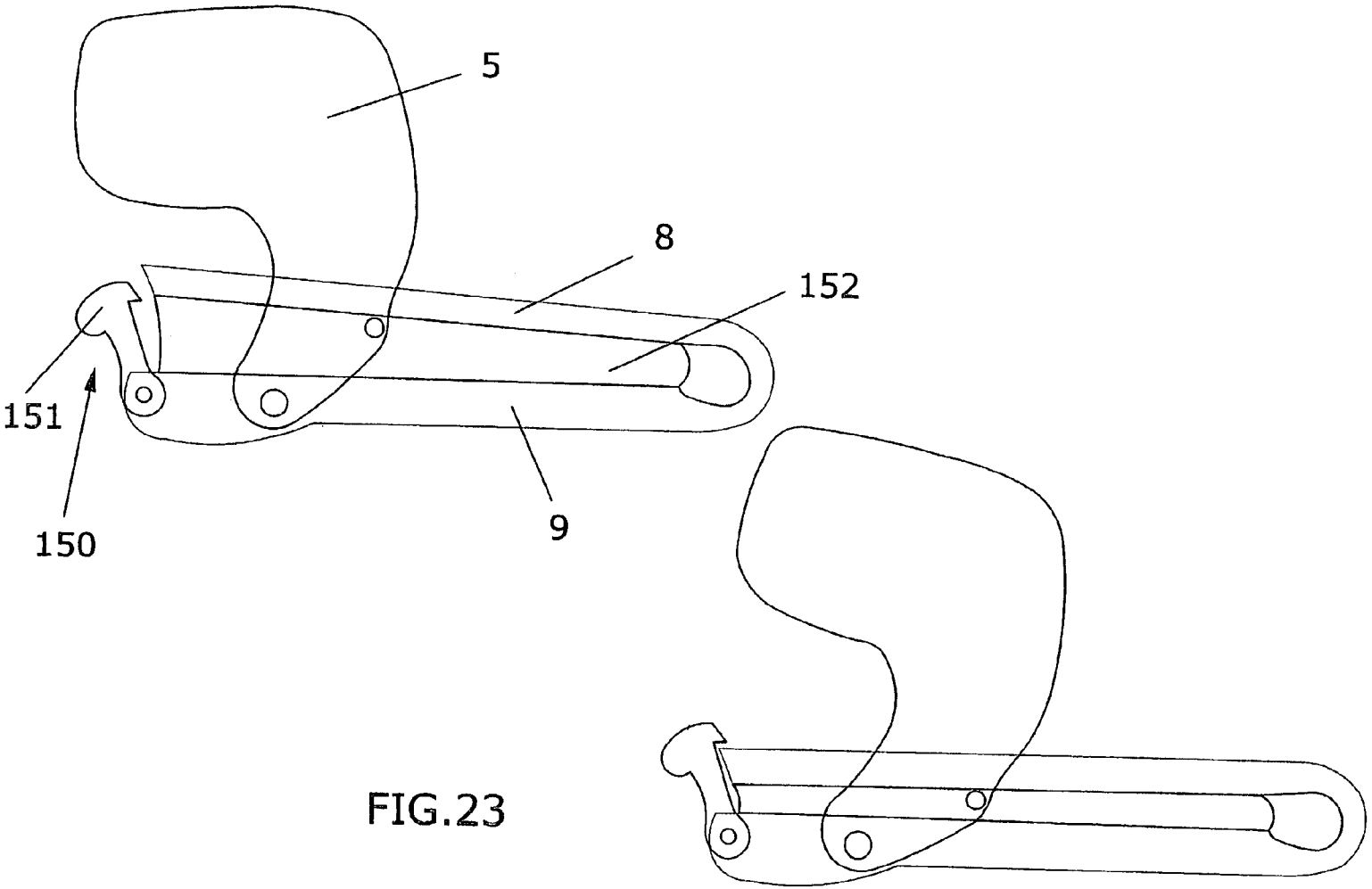
FIG. 23 shows another embodiment in which the retaining means in an open position are elastic materials.

FIG. 23 shows the retaining-releasing means (150) actuated by the trigger (151), in which the means used to keep it in the open position are a rubber band or similar elastic element (152), the upper element (8) and lower element (9) being hinged at their union by the elastic properties of the material of which they are made, not requiring a hinge as such.

Figure 24:
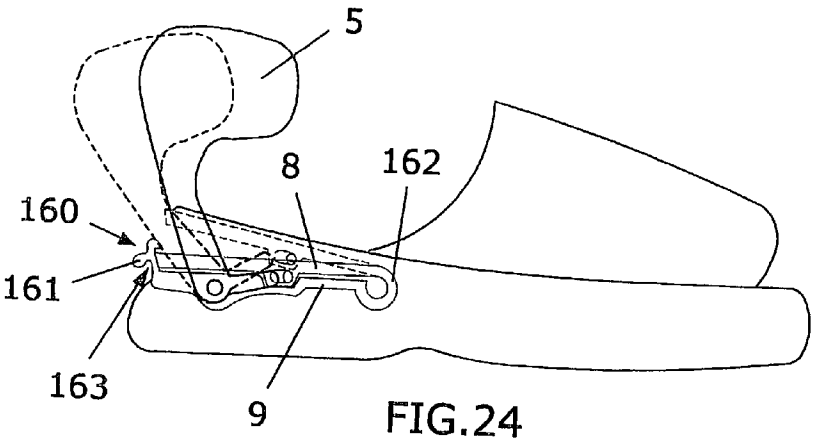
FIGS. 24, 25 and 26 show other embodiments which make use of the flexibility of the materials.

FIG. 24 shows the retaining-releasing means (160) together with the actuation trigger (161) that are actuated by deformation, as they are provided with a flexible part (163) in their union to the lower element (9), while on the other side the union of the upper element (9) to the lower element (8) is provided with a flexible area (162) meant to keep the assembly in an open position.

Figure 25:
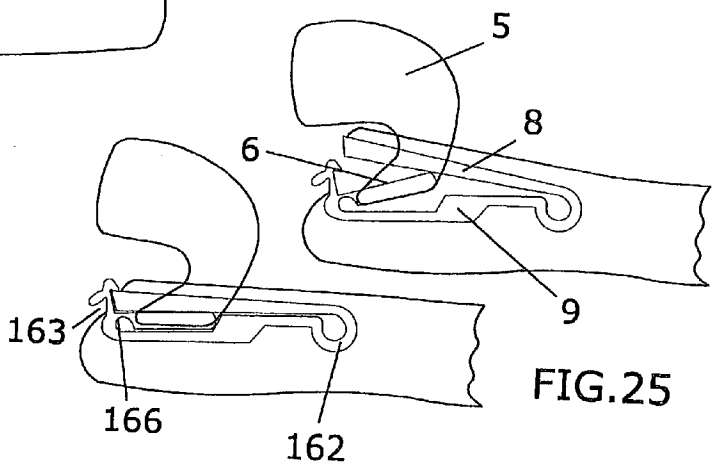

In FIG. 25 the retaining-releasing means are also based on the use of a flexible area (163) in the union of the retaining-releasing means with the lower element (9), as well as another flexible area (166) established in the union of the mobile support (6) to the lower element (9), forming a single piece, the mobile support (6) being meant to maintain the assembly in the open position together with the flexible area (162) established in the union of the upper element (8) to the lower element (9).

Figure 26:
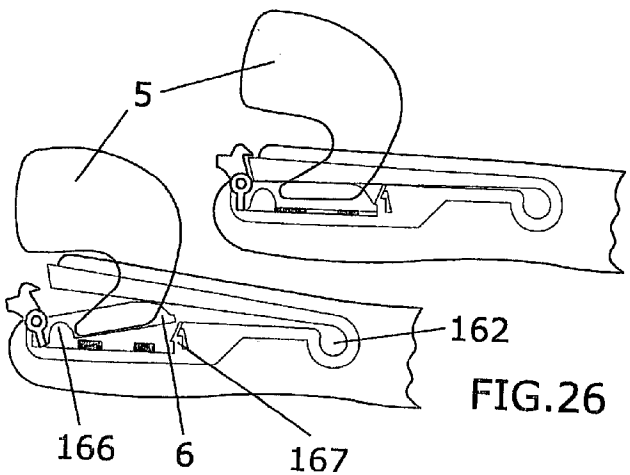

Finally, FIG. 26 shows another alternative in which in addition to the flexible area (166) between the mobile support (6) and the lower element (9) there is a flexible area (167) in charge of retaining the mobile support (6), also having the flexible area (162).

The essence of this invention is not affected by variations in the materials, shape, size and arrangement of its component elements, which are described in a non-limiting manner, to allow its reproduction by an expert.

The invention claimed is:

1. A shoe with automatic closure, the shoe being of the type comprising:

a sole with a toe piece to which is attached at least one front attachment element for holding a front part of the foot, and a heel piece to which is connected at least one rear attachment element to hold part of the heel of the foot, the rear attachment element is part of, at least one mobile support that can move from an open position in which the rear attachment element is separated from the part of the heel of the foot;

an upper element and a lower element hinged to each other in one of its ends wherein:

the upper element is hinged with the lower element in one of its ends, in the middle of the sole, in the junction zone between the heel and the rest of the sole, while the other ends of the upper element and lower element, are separated when the shoe is open and near when the shoe is closed;

The shoe it is maintained in a closed position by first reversible retaining-realising means; the first reversible retaining-realising means includes a protrusion, respectively, susceptible of being actuated by the other foot, realising the upper element;

the shoe is maintained in open position by second retaining-realising means.

2. The shoe according to claim 1 wherein the upper and lower elements are hinged to each other by a hinge ping.

3. The shoe according to claim 1 wherein: the mobile support is connected to a shaft, mounted on the lower element, so that it can turn at least a certain angle between the open and close positions, through a lever being fixedly joined to the shaft, having the lever a distal end that slides or rolls on the upper element.

4. The shoe according to claim 3 wherein the upper element includes guide means for the distal end of the lever, the guide means restricting the sideways relative motion between the distal end and the upper element and allowing a translation movement of the distal end with respect to the upper element.

5. Shoe according to claim 4 wherein: the guide means comprise at least one pair of grooves attached to the upper element or being part of it, in which are slidably inserted corresponding lugs that extend laterally from the distal end of the lever.

6. The shoe according to claim 4 wherein: the distal end is rounded and slides on a contact track of a strong material with a low coefficient of friction with respect to the material of the distal end of the lever.

7. The shoe according to claim 3 wherein: the second retaining-realising means comprise elastic means, which act on the lever to push the mobile support to the open position and to separate the upper and lower elements.

8. The shoe according to claim 3 wherein said first retaining-releasing means comprise a trigger with a tab, this trigger being mounted on the upper element or lower element that it is free to turn about a pin and is pushed by a spring towards a retaining position where said tab engages an anchoring provided in the opposite lower element and upper element when the mobile support is in the closed position.

9. The shoe according to claim 8 characterised in that the trigger includes a surface that can come in contact with a surface of the anchoring, these surfaces being configured and arranged so that the trigger is displaced by the surface against the action of the spring, while the upper element and the lower element approach each other to allow the anchoring to pass in front of the aforementioned tab, and the trigger is released when the mobile support reaches the closed position to allow coupling the tab in the anchoring.

10. The shoe according to claim 8 wherein: the trigger comprises a protrusion that can be accessed from the outside and that can be actuated by the user when the mobile support is in the closed position to move the trigger against the action of said spring in order to release the coupling of the tab in the anchoring and allow the mobile support to move to the open position by the elastic means.

11. The shoe according to claim 9 wherein: the anchoring mounted on the upper element or the lower element has inclined side ends that in the closed position are inserted in the inclined walls of a cavity that exists in the opposite lower element or upper element where the trigger is housed.

12. The shoe according to claim 2 wherein: the first retaining means comprise elastic means that act on the mechanism to push the mobile support to the closed position and the second retaining means retain the mobile support in the open position against the action of the elastic means, the second retaining means being configured and arranged in relation to the upper and lower elements so that when the upper element is pressed on by the heel of the user's foot to bring it near the lower element, the aforementioned second retaining means are released and with them the aforementioned mobile support moves to said closed position by the action of the elastic means.

13. The shoe according to claim 12 wherein the mobile support can be displaced by the user from the closed position to the open one against the action of the elastic means, during which displacement the upper and lower elements are separated or allowed to separate until the second retaining means are automatically placed in a retaining position for the mobile support in the open position.

14. The shoe according to 1 wherein: the upper element is joined to said toe piece of the sole and the lower element moves downward with respect to it, being hinged through a pin in one of its ends, the one placed between the heel and the rest of the sole.

15. The shoe with automatic closure, according to claim 1, wherein: the hinge between the upper element and the lower element is established by a front hinge, while the hinge between the upper part and the mobile support that is connected to the rear attachment element is established by a central shaft; in addition, said mobile support is hinged to the lower element by the rear shaft, this rear shaft also hinging the retaining-releasing element to the lower element.

16. The shoe with automatic closure, according to claim 15, wherein: the first retaining-releasing means for keeping the rear attachment element in a closed position are provided with an actuation tab that by pressing against the action of a spring and revolving about the rear shaft moves the tab and releases the rear part of the upper element, raising it by elastic means.

17. The shoe with automatic closure, according to claim 16, wherein: the releasable retaining means for the open position consist of an elastic element disposed on the front pivoting shaft between the upper element and the lower element.

18. The shoe with automatic closure, according to claim 17, wherein: the releasable retaining means for the open position consist of an elastic means disposed vertically between the lower piece and the upper piece.

19. The shoe with automatic closure, according to claim 16, wherein: the releasable retaining means for the open position consist of an elastic means which when compressed acts pushing back the central shaft.

20. The shoe with automatic closure, according to claim 16, wherein: regardless of the shape of the releasable retaining means for the open position used, the central shaft runs through an oblong orifice through which slides said shaft by the action of the releasable elastic retaining means for the open position.

21. The shoe with automatic closure, according to claim 16, wherein: alternatively to the upper part having an oblong orifice through which the central shaft runs, it is provided on its sides with corresponding lugs that are housed in elongated or oblong orifices made in the mobile support such that they allow a hinged union of the mobile support and the upper element, the lateral lugs of the upper element sliding in said oblong orifice.

22. The shoe with automatic closure, according to claim 16, wherein: the rear attachment element is provided with an orifice on each of its sides in which is hinged a hinged part of the front part, this front hinged part being joined to the rear attachment element by a hinge; in addition, the hinged part is also provided with a degree of freedom in its union to the front part through the hinge area.

23. The shoe with automatic closure, according to claim 16, wherein: the hinged part as shown can be configured in the form of a belt that runs from side to side under guides, and is retains in the hinges so that when the assembly is closed when the hinge moves down it pulls on the belt pressing on the upper and improving its hold.

24. The shoe with automatic closure, according to claim 1, wherein: the retaining-releasing means are placed on the rear end of the upper element anchored on an incut defined in the lower element, with the hinge of the rear attachment element and the upper element above it.

25. The shoe with automatic closure, according to claim 1, wherein: the retaining-releasing means actuated by the trigger is joined to the sole or to the lower element, the rear retaining element having an arm on which acts the elastic means to keep it in this position.

26. The shoe with automatic closure, according to claim 1, wherein there is no central shaft on the upper element, being provided with retaining-releasing means actuated by a trigger, so that joined to the lower part of the upper element is an additional element that does not require a central hinge.

27. The shoe with automatic closure, according to claim 1, wherein: between the upper element and the rear attachment element a gearwheel is provided by the support to which it is joined, such that the friction in said joint is greatly reduced.

28. The shoe with automatic closure, according to claim 1, wherein: the means for keeping the assembly in the open position are based on using elastic means such as rubber or the like.

29. The shoe with automatic closure, according to claim 1, wherein the means for keeping the assembly in the open position are based on using a flexible area in the union between the upper element and the lower element.

30. The shoe with automatic closure, according to claim 1, wherein: the retaining-releasing means are provided with a flexible area at its union to the lower element forming a single piece.

31. The shoe with automatic closure, according to claim 1, wherein: the mobile support is provided at its union with the lower element with a flexible area forming a single piece.

32. The shoe with automatic closure, according to claim 1, wherein: the mobile support is also provided at its front area with a flexible retaining area.

* * * * *

UNITED STATES PATENT AND TRADEMARK OFFICE

CERTIFICATE OF CORRECTION

PATENT NO. : 7,059,069 B2
APPLICATION NO. : 10/500551
DATED : June 13, 2006
INVENTOR(S) : Francis Raluy et al.

It is certified that error appears in the above-identified patent and that said Letters Patent is hereby corrected as shown below:

On the Title of the Patent:

Item 76 Page 1: The second named Inventor, "Antonio Martinez" should read --Antonio Meca Martinez--

Item 76 Page 1: The address of the second named Inventor, "Ctra. Aldea-Tortosa, KM 1 a/n, 43896 Aldea, Tarragona (ES)" should read -- Balmes, 56 ent. 2ª-08007 Barcelona Spain --

Signed and Sealed this

Thirtieth Day of January, 2007

JON W. DUDAS
*Director of the United States Patent and Trademark Office*